US008131170B2

(12) United States Patent
Kurz

(10) Patent No.: US 8,131,170 B2
(45) Date of Patent: Mar. 6, 2012

(54) METHOD AND APPARATUS FOR CONTROLLING LEVEL OF MARKING MATERIAL IN A WASTE SUMP

(75) Inventor: Karl Edwin Kurz, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 466 days.

(21) Appl. No.: 12/488,992

(22) Filed: Jun. 22, 2009

(65) Prior Publication Data

US 2010/0322645 A1 Dec. 23, 2010

(51) Int. Cl.
*G03G 21/00* (2006.01)
*G03G 21/12* (2006.01)

(52) U.S. Cl. ..... 399/35; 399/346; 399/358; 399/360

(58) Field of Classification Search ..... 399/34, 399/35, 71, 346, 350, 358, 359, 360
See application file for complete search history.

(56) References Cited

U.S. PATENT DOCUMENTS

| | | | | |
|---|---|---|---|---|
| 4,982,230 | A * | 1/1991 | Ogura et al. | 399/35 |
| 5,575,408 | A | 11/1996 | Marqueling et al. | |
| 5,778,296 | A * | 7/1998 | van der Steen et al. | 399/360 |
| 5,835,823 | A | 11/1998 | Damji et al. | |
| 6,580,881 | B2 * | 6/2003 | Coriale et al. | 399/35 |
| 6,640,061 | B2 * | 10/2003 | Higgins et al. | 399/35 |
| 6,771,927 | B2 * | 8/2004 | Bloemen et al. | 399/358 |
| 7,660,541 | B2 * | 2/2010 | Tanimoto et al. | 399/35 |
| 2003/0234262 | A1 | 12/2003 | Hart | |
| 2006/0120779 | A1 * | 6/2006 | Uchihashi | 399/358 |

FOREIGN PATENT DOCUMENTS

| | | | |
|---|---|---|---|
| JP | 11167327 | A * | 6/1999 |
| JP | 2007298623 | A * | 11/2007 |
| JP | 2008070804 | A * | 3/2008 |
| JP | 2009080473 | A * | 4/2009 |

* cited by examiner

*Primary Examiner* — David Gray
*Assistant Examiner* — Fred L Braun
(74) *Attorney, Agent, or Firm* — Ronald E. Prass, Jr.; Prass LLP

(57) ABSTRACT

A printing apparatus and corresponding method for maintaining a level of a marking material in a marking material waste sump of a printing apparatus to a desired level. The printing apparatus includes a photoreceptor, a cleaning blade for cleaning marking material from the photoreceptor, a waste sump containing the marking material cleaned from the photoreceptor by the cleaner blade, the waste sump including an auger for selectively removing a portion of the marking material from the waste sump when activated, a determining device for determining a level of the marking material in the waste sump, and a controller receiving the determined level of the marking material from the determining device, the controller maintaining the level of the marking material in the waste sump to at or above a desired level by selectively activating the auger when the level of the marking material rises to a predetermined level and deactivating the auger when the level of the marking material is at the desired level, the desired level of the marking material providing a portion of the marking material to the photoreceptor to be used as lubricant between the photoreceptor and the cleaner blade.

19 Claims, 3 Drawing Sheets

METHOD AND APPARATUS FOR CONTROLLING LEVEL OF MARKING MATERIAL IN A WASTE SUMP

BACKGROUND

Disclosed are methods and apparatus for controlling a level of a marking material in a waste sump. The apparatus may be a printing apparatus.

The basic principles of electrostatographic printing with dry marking material generally referred to as xerography) are well known: an electrostatic latent image is created on a charge-retentive surface, such as a photoreceptor or other charge receptor, and the latent image is developed by exposing it to a supply of toner particles, which are attracted as needed to appropriately-charged areas of the latent image. The toner particles are then transferred in imagewise fashion from the photoreceptor to a print sheet, the print sheet being subsequently heated to permanently fuse the toner particles thereto to form a durable image.

Following the transfer of the image from the photoreceptor to the print sheet, residual toner particles remaining on the photoreceptor are removed by any number of known means, such as a cleaning blade, brush, and/or vacuum. In a typical embodiment, the removed toner is accumulated in a hopper. Accumulated waste toner is directed, typically by an auger, into a waste container.

The toner acts as a lubricant between the photoreceptor and the cleaning blade. If there is not enough toner left on the photoreceptor after transfer of the image to the print sheet, there may be increased wear on the photoreceptor and/or the cleaning blade, which could result in premature failure. There are many potential causes that can lead to the condition of not enough toner on the photoreceptor after transfer of the image to the print sheet. Many of these causes are customer driven & machine environment driven (for example: extended low area coverage print jobs in one or more colors; or temperature, humidity, altitude). Any other variability, such as manufacturing variability or design change variability, that causes a xerographic setpoint, such as developed toner mass or toner transfer efficiency, can also cause the condition of not enough toner on the photoreceptor after transfer of the image to the print sheet. This condition may result in insufficient toner left on the photoreceptor to act as an effective lubricant.

SUMMARY

According to aspects of the embodiments, there is provided a printing apparatus and corresponding methods. The printing apparatus includes a photoreceptor, a cleaning blade for cleaning marking material from the photoreceptor, a waste sump containing the marking material cleaned from the photoreceptor by the cleaner blade, the waste sump including an auger for selectively removing a portion of the marking material from the waste sump when activated, a determining device for determining a level of the marking material in the waste sump, and a controller receiving the determined level of the marking material from the determining device, the controller maintaining the level of the marking material in the waste sump to at or above a desired level by selectively activating the auger when the level of the marking material rises to a predetermined level and deactivating the auger when the level of the marking material is at the desired level, the desired level of the marking material providing a portion of the marking material to the photoreceptor to be used as lubricant between the photoreceptor and the cleaner blade.

DETAILED DESCRIPTION

Figure 1:
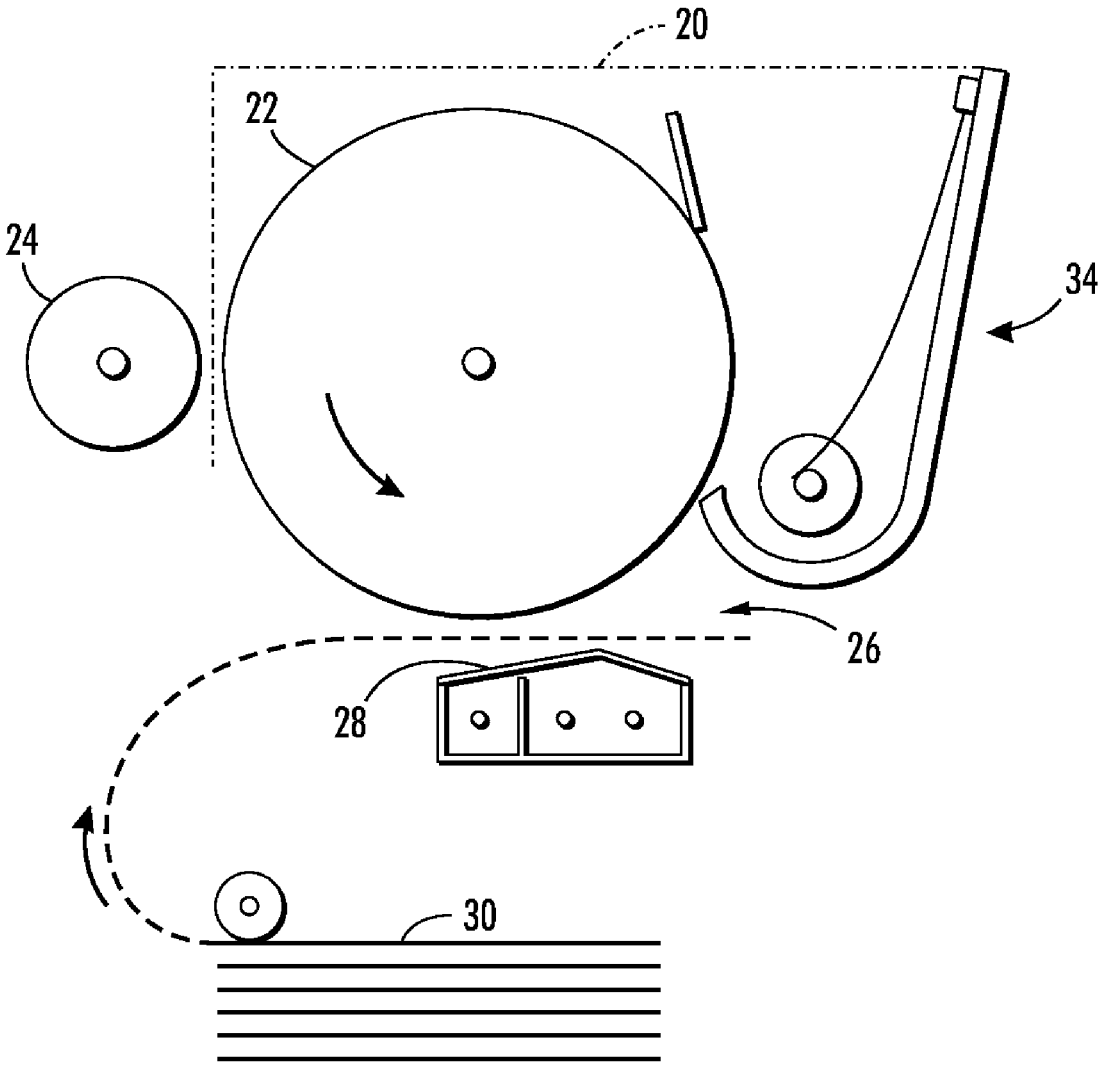
FIG. 1 illustrates a schematic view of a printing apparatus.

While the present invention will be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

The embodiments include a printing apparatus, including a photoreceptor, a cleaning blade for cleaning marking material from the photoreceptor, a waste sump containing the marking material cleaned from the photoreceptor by the cleaner blade, the waste sump including an auger for selectively removing a portion of the marking material from the waste sump when activated, a determining device for determining a level of the marking material in the waste sump, and a controller receiving the determined level of the marking material from the determining device, the controller maintaining the level of the marking material in the waste sump to at or above a desired level by selectively activating the auger when the level of the marking material rises to a predetermined level and deactivating the auger when the level of the marking material is at the desired level, the desired level of the marking material providing a portion of the marking material to the photoreceptor to be used as lubricant between the photoreceptor and the cleaner blade.

The embodiments further include a method of maintaining a level of a marking material in a marking material waste sump of a printing apparatus to a desired level, the printing apparatus having a photoreceptor and a cleaning blade for cleaning marking material from the photoreceptor. The method includes determining a level of the marking material in the marking material waste sump of the printing apparatus, wherein the marking material waste sump includes an auger for selectively removing a portion of the marking material from the sump, and maintaining the level of the marking material within the waste sump to at or above a desired level by selectively activating the auger when the level of the marking material rises above a predetermined level and deactivating the auger when the level of the marking material is at the desired level, the desired level providing a portion of the marking material as lubricant between the photoreceptor and the cleaner blade.

The embodiments further include a printing apparatus that includes a cleaning blade for cleaning marking material from a photoreceptor, a waste sump containing the marking material cleaned from the photoreceptor by the cleaner blade, the waste sump including a marking material removal device for selectively removing a portion of the marking material from the waste sump when activated, a sensor for determining a level of the marking material in the waste sump, and a controller receiving the determined level of the marking material from the sensor, the controller maintaining the level of the marking material in the waste sump to at or above a desired level by selectively activating the marking material removal device when the level of the marking material rises to a predetermined level and deactivating the marking material removal device when the level of the marking material is at the desired level, the desired level of the marking material providing a portion of the marking material to the photoreceptor to be used as lubricant between the photoreceptor and the cleaner blade.

In as much as the art of electrophotographic printing is well known, the various elements employed in the FIG. 1 printing machine will be shown schematically and their operation described briefly with reference thereto. Various other printing machines could also be used, and this is only an example of a particular printing machine that may be used with the invention.

FIG. 1 is a simplified elevational view showing elements of an electrostatographic or xerographic printing apparatus many of disposed within a module housing generally shown as 20. As is well known, an electrostatic latent image is created, by means not shown, on a surface of a charge receptor or photoreceptor 22. The photoreceptor 22 can be a drum (as shown) or a flexible belt. The latent image on the photoreceptor is developed by applying thereto a supply of toner particles, such as with developer roll 24. The developer roll can be of any of various designs such as a magnetic brush roll or donor roll, as is familiar in the art. The toner particles adhere to the appropriately-charged areas of the latent image on the photoreceptor 22. The surface of the photoreceptor 22 then moves, as shown by the arrow, to a transfer zone 26 created by a transfer-detack assembly generally indicated as 28. Simultaneously, a print sheet on which a desired image is to be printed is drawn from supply stack 30 and conveyed to the transfer zone 26.

At the transfer zone 26, the print sheet is brought into contact or at least proximity with a surface of photoreceptor 22, which at this point is carrying toner particles thereon. A corotron or other charge source at transfer zone 26 causes the toner on the photoreceptor 22 to be electrically transferred to the print sheet. The print sheet is then sent to subsequent stations, as is familiar in the art, such as a fuser and finishing devices (not shown).

Figure 2:
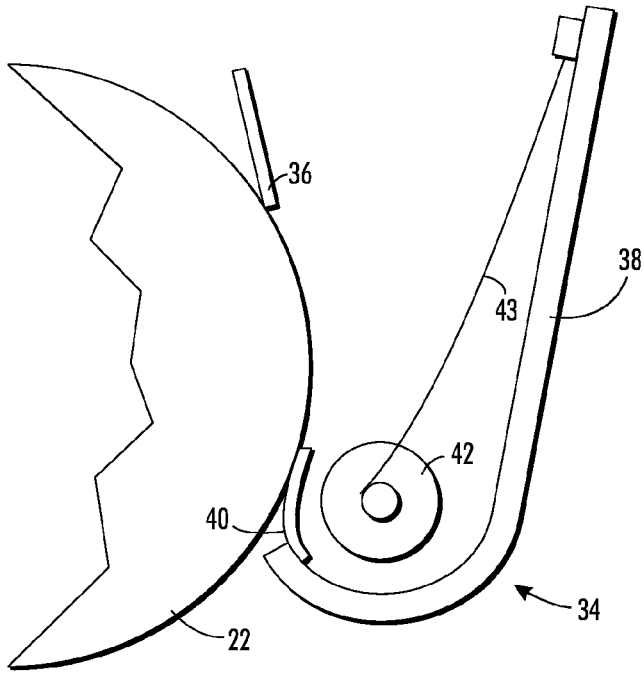
FIG. 2 illustrates a schematic view of a cleaning station forming a part of the printing apparatus of FIG. 1.

Following transfer of most of the toner particles to the print sheet in the transfer zone, any residual toner particles remaining on the surface of the photoreceptor 22 are removed at a cleaning station, which is generally indicated as 34. FIG. 2 is an enlarged elevational view of a cleaning station 34. As can be seen in FIG. 2, a cleaning blade 36 is urged against the surface of photoreceptor 22 and scrapes the residual toner off the surface. The toner thus removed falls downward into the housing forming a waste sump 38 for accumulating the toner. A flexible flap seal 40, extending the length of the photoreceptor 22, may be used to prevent loose toner from escaping the waste sump 38.

At the bottom of the waste sump 38 is an auger 42, here shown end-on. The auger extends substantially the length of the photoreceptor 22. The auger 42 is rotated and thus conveys toner particles out of the bottom of the waste sump 38 to a waste container (not shown). An agitator 43, made of a thin, flexible material, can interact with the auger to clean the flanges or flights of the auger 42. The auger may be selectively turned on and off.

Figure 3:
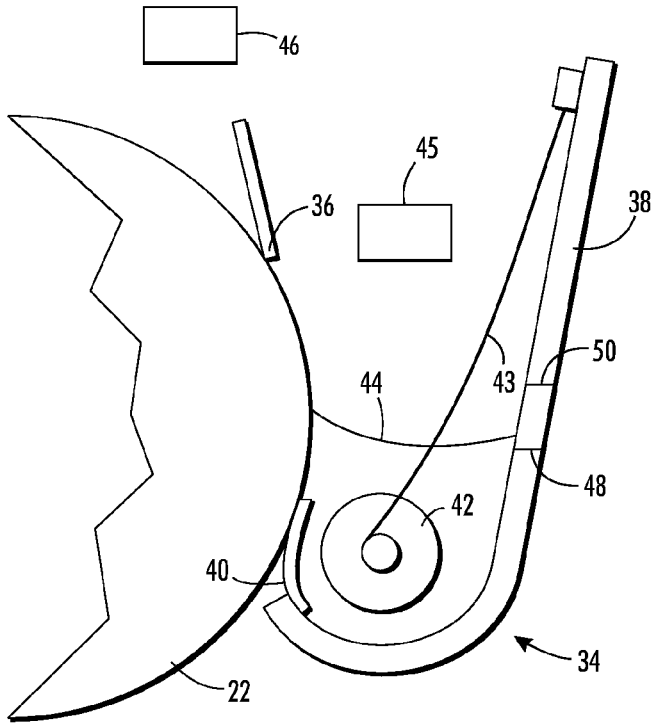
FIG. 3 illustrates a schematic view of a cleaning station forming a part of the printing apparatus of FIG. 1.

FIG. 3 illustrates the cleaning station 34 with additional elements as compared to FIG. 2. Waste toner 44 used as the marking material is in the waste sump 38 forming. In accordance with embodiments, a level of the toner 44 within the waste sump 38 is controlled to be maintained at or above a desired level 48. If a level of the toner 44 in the waste sump 38 was allowed to fall to a level where it would not contact with the photoreceptor 22, this could result in insufficient lubrication between the photoreceptor 22 and the cleaning blade 36. By keeping the toner 44 at or above a desired level 48 within the waste sump 38, the toner 44 from the waste sump 38 provides the needed lubrication between the photoreceptor 22 and the cleaning blade 36.

The embodiments may include a sensor 45 for determining a level of the toner 44 within the waste sump 38. The sensor 45 may be an optical sensor, or another type of sensor capable of determining a level of toner 44 in the waste sump 38.

The sensor 45 may report the level of the toner to a controller, such as controller 46. The controller 46 may be a controller used to control functionality of the printing apparatus, or could be a separate controller used to control the level of the toner 44. The sensor 45 may be connected to the controller in any way, such as a wired connection, wireless, or the like.

The controller 46 operates to keep the toner 44 in the waste sump 38 at or above a desired level 48 so as to provide a sufficient amount of contact between toner in the waste sump 38 with the photoreceptor 22 to provide the needed lubrication. The desired level 48 for the toner 44 may be a level high enough to leave some leeway such that if the level were to drop a small amount below the desired level 48, there would still be sufficient contact between the toner 44 in the waste sump 38 and the photoreceptor 22 to provide the needed amount of toner 44 to the photoreceptor 22. The desired level 48 may be predetermined based on various factors, such as the type of toner being used, and a needed amount of lubrication.

Upon receiving a signal that the toner 44 in the waste sump 38 is at or above a predetermined level 50 above the desired level, the controller 46 will activate the auger 42 to remove toner from the waste sump 38. When the level of the toner 44 in the waste sump 38 drops to at or near the desired level 48, the controller 46 will deactivate the auger 42. The toner in the waste sump 38 can then start to build up again. In this way, the controller 46 controls the level of the toner in the waste sump to be at or above the desired level 48, allowing sufficient toner 44 from the waste sump 38 to be in contact with the photoreceptor 22.

The embodiments may determine a level of the toner 44 in the waste sump 38 in ways other than using the sensor 45. For example, the embodiments could use the controller 46 with a regression equation to determine a level of the toner 44 in the waste sump 38. The regression equation could include various factors to calculate the level of the toner 44. The factors used could include factors affecting an amount of toner used in the printing process based on a number of pixels of print sheets, a speed of the print sheets, print sheet sizes, and the like. The regression equation can determine a level of the toner 44 in the waste sump 38, and the controller 46 then activates the auger 42 to keep the level of the toner 44 in the waste sump 38 at or above the desired level 48.

The embodiments may also determine a level of the toner 44 in the waste sump 38 based on a measured amount of torque needed to turn the auger 42. As the amount of toner 44 builds up in the waste sump 38, an increasing amount of torque will be required to turn the auger 42. Thus, embodiments may determine a level of the toner 44 in the waste sump 38 based on the torque needed to turn the auger 42. The embodiments may activate the auger 42 to determine the level of the toner 44 based on the measured torque, and deactivate the auger 42 when the torque falls to a predetermined level of torque, where the predetermined level of torque corresponds to a level of toner 44 at or above the desired level 48 of toner 44 in the waste sump 38. The above methods of determining the level of the toner could also be combined into a method.

Figure 4:
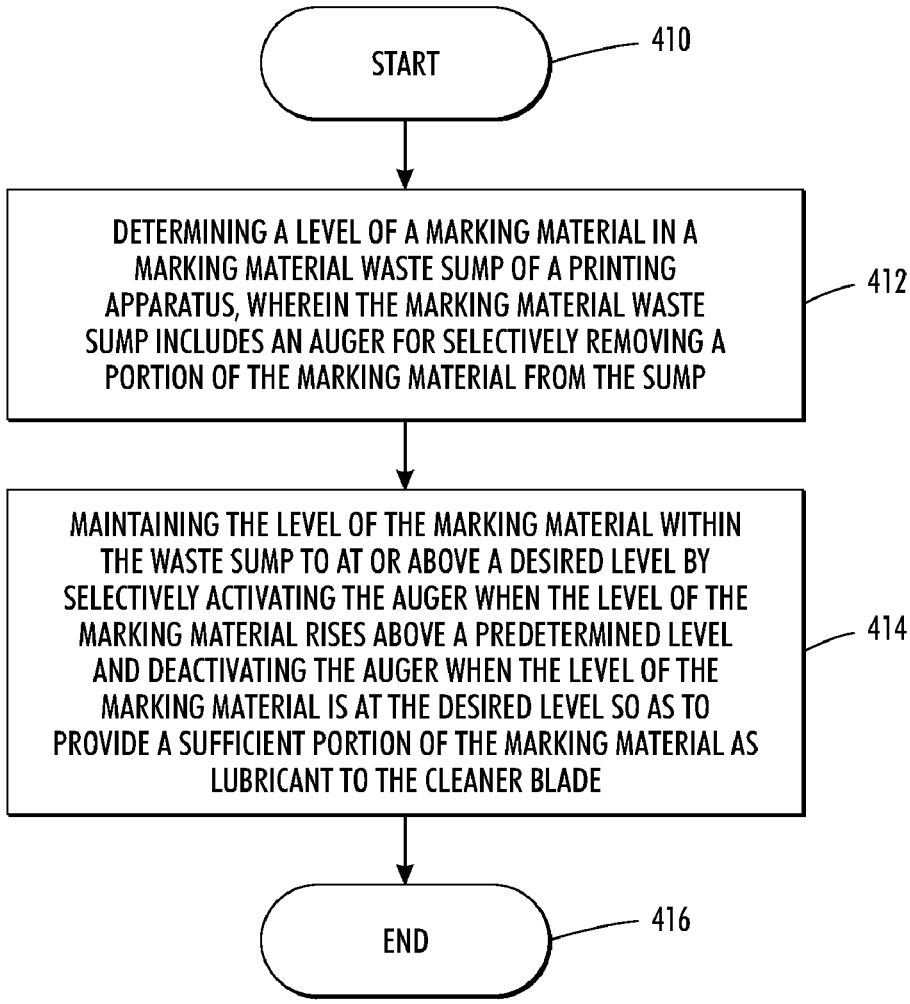
FIG. 4 illustrates a flow chart of a method in accordance with the embodiments.

FIG. 4 is a flow chart illustrating a method according to embodiments. The method starts at 410.

At 412, a level of marking material in the waste sump, which may be toner, is determined. The marking material waste sump includes an auger for selectively removing a portion of the marking material from the waste sump.

In 414, the level of the marking material within the waste sump is maintained at or above a desired level. The level of the marking material is maintained by selectively activating the auger when the level of the marking material rises above a predetermined level and deactivating the auger when the level of the marking material is at the desired level so as to provide a portion of the marking material as lubricant to a cleaning blade.

It will be appreciated that various of the above-disclosed and other features and functions, or alternatives thereof, may be desirably combined into many other different embodiments. Also that various presently unforeseen or unanticipated alternatives, modifications, variations or improvements therein may be subsequently made by those skilled in the art which are also intended to be encompassed by the following claims.

What is claimed is:

1. A printing apparatus, comprising:

a photoreceptor;

a cleaning blade for cleaning marking material from the photorecptor;

a waste sump containing the marking material cleaned from the photoreceptor by the cleaner blade, the waste sump including an auger for selectively removing a portion of the marking material from the waste sump when activated;

a determining device for determining a level of the marking material in the waste sump; and a controller receiving the determined level of the marking material from the determining device, the controller maintaining the level of the marking material in the waste sump to at or above a desired level by selectively activating the auger when the level of the marking material rises to a predetermined level and deactivating the auger when the level of the marking material is at the desired level, the desired level of the marking material providing a sufficient portion of the marking material to the photoreceptor as lubricant between the photoreceptor and the cleaner blade.

2. The printing apparatus of claim 1, wherein the determining device comprises a sensor for sensing the level of the marking material.

3. The printing apparatus of claim 1, wherein the determining device comprises the controller.

4. The printing apparatus of claim 3, wherein the controller uses at least one of a number of pixels of print sheets printed in the printing apparatus, a speed of the print sheets, and a print sheet size to determine the level of the marking material.

5. The printing apparatus of claim 3, wherein the controller receives a torque indication corresponding to an amount of torque required to turn the auger.

6. The printing apparatus of claim 5, wherein the controller determines that the level of the marking material is at the desired level when the torque indication corresponds to a predetermined level of torque.

7. The printing apparatus of claim 1, wherein the marking material is toner.

8. A method of maintaining a level of a marking material in a marking material waste sump of a printing apparatus to a desired level, the printing apparatus having a photoreceptor and a cleaning blade for cleaning marking material from the photoreceptor, comprising:

determining a level of the marking material in the marking material waste sump of the printing apparatus, wherein the marking material waste sump includes an auger for selectively removing a portion of the marking material from the sump; and maintaining the level of the marking material within the waste sump to at or above a desired level by selectively activating the auger when the level of the marking material rises above a predetermined level and deactivating the auger when the level of the marking material is at the desired level, the desired level providing a sufficient portion of the marking material to be provided as lubricant between the photoreceptor and the cleaner blade.

9. The method of claim 8, wherein a sensor determines the level of the marking material.

10. The method of claim 8, wherein a controller maintains the level of the marking material.

11. The method of claim 10, wherein the controller uses at least one of a number of pixels of print sheets printed in the printing apparatus, a speed of the print sheets, and a print sheet size to determine the level of the marking material.

12. The method of claim 8, wherein determining a level of the marking material comprises receiving a torque indication corresponding to an amount of torque required to turn the auger.

13. The method of claim 12, wherein the level of the marking material is determined to be at the desired level when the torque indication corresponds to a predetermined level of torque.

14. The method of claim 8, wherein the marking material is toner.

15. A printing apparatus comprising:

a cleaning blade for cleaning marking material from a photorecptor;

a waste sump containing the marking material cleaned from the photoreceptor by the cleaner blade, the waste sump including a marking material removal device for selectively removing a portion of the marking material from the waste sump when activated;

a sensor for determining a level of the marking material in the waste sump; and a controller receiving the determined level of the marking material from the sensor, the controller maintaining the level of the marking material in the waste sump to at or above a desired level by selectively activating the marking material removal device when the level of the marking material rises to a predetermined level and deactivating the marking material removal device when the level of the marking material is at the desired level, the desired level of the marking material providing a sufficient portion of the marking material to the photoreceptor to be used as lubricant between the photoreceptor and the cleaner blade.

16. The printing apparatus according to claim 15, wherein the controller uses at least one of a number of pixels of print sheets printed in the printing apparatus, a speed of the print sheets, and a print sheet size to determine the level of the marking material.

17. The printing apparatus according to claim 15, wherein the controller receives a torque indication corresponding to an amount of torque required to activate the marking material removal device.

18. The printing apparatus according to claim 17, wherein the controller determines that the level of the marking material is at the desired level when the torque indication corresponds to a predetermined level of torque.

19. The printing apparatus according to claim 15, wherein the marking material is toner.

* * * * *